US006691693B1

(12) United States Patent
Trussell, II

(10) Patent No.: US 6,691,693 B1
(45) Date of Patent: Feb. 17, 2004

(54) OPEN SIDE BOW CASE WITH DETACHABLE FREE FORM BLIND

(75) Inventor: Hugh D. Trussell, II, Jackson, MS (US)

(73) Assignee: Blue Sky Investments, Inc., Jackson, MS (US)

( * ) Notice: Subject to any disclaimer, the term of this patent is extended or adjusted under 35 U.S.C. 154(b) by 0 days.

(21) Appl. No.: 10/270,652

(22) Filed: Oct. 16, 2002

(51) Int. Cl.[7] ..... B65D 65/04; B65D 85/00

(52) U.S. Cl. ..... 124/25.6; 124/80; 150/154; 206/315.11; 206/317; 224/607; 224/916

(58) Field of Search ..... 124/25.6, 80, 86; 150/154; 206/315.11, 317; 224/607, 916

(56) References Cited

U.S. PATENT DOCUMENTS

| | | | | |
|---|---|---|---|---|
| 586,533 | A | | 7/1897 | Gates |
| 3,058,505 | A | | 10/1962 | Emmett |
| 4,480,774 | A | * | 11/1984 | Smith et al. |
| 4,865,900 | A | | 9/1989 | Shannon et al. |
| 5,450,957 | A | | 9/1995 | Erb |
| 5,513,621 | A | | 5/1996 | Vanskiver |
| 5,528,849 | A | | 6/1996 | Plinta |
| 5,609,175 | A | | 3/1997 | Gerry et al. |
| 5,630,439 | A | | 5/1997 | Hutto |
| 5,730,341 | A | | 3/1998 | Hester, Jr. |
| 5,832,912 | A | | 11/1998 | Olivarez |
| 5,893,502 | A | | 4/1999 | Redzisz |
| 6,119,907 | A | | 9/2000 | Benjamin |
| 6,250,470 | B1 | * | 6/2001 | Mackenzie |
| 2002/0036007 | A1 | | 3/2002 | Sellers |

OTHER PUBLICATIONS

Photograph of "Example of convention 'soft' case used to carry a bow."
Photograph of "Example of conventional 'soft' case used to carry a bow."

* cited by examiner

*Primary Examiner*—John A. Ricci
(74) *Attorney, Agent, or Firm*—Jacobson Holman PLLC

(57) ABSTRACT

A bow case for receiving and carrying a compound bow. The bow case is of non-rigid cloth-like fabric material having a first face and a second face opposite thereto. The second face defines a bow entry opening for receiving the bow to be carried. The first and second faces have a perimeter that substantially conform to the overall shape of the compound bow. The open face includes a drawstring or other tensioning element to tautly secure the bow within the case. A blind is detachably connected to the case, specifically to the interior wall of the first face of the case. The blind is detachably connected within a blind storage pocket sewn to the interior wall of the case.

18 Claims, 4 Drawing Sheets

OPEN SIDE BOW CASE WITH DETACHABLE FREE FORM BLIND

BACKGROUND OF THE INVENTION

1. Field of the Invention

The invention relates to a bow case for carrying an archery bow, such as a compound bow used for hunting. The bow case is formed of a non-rigid cloth-like material defining a first, or back, side and a second, or front, side with a bow entry opening therein. The bow entry opening forms a substantial portion of the area of the front side to receive the compound bow. The bow remains exposed through the entry opening thus enabling a quiver with attached arrows to remain attached on the bow during transport. Within the case, associated with the interior of the back side of the case, is a pocket to receive and store a blind for shielding the hunter in the field. The blind is removably secured within the pocket.

2. Description of the Related Art

Various soft flexible bow cases are known in the art. These cases are used by the hunter to transport a bow from a hunter's vehicle, for example, to a location in the woods, typically to a hunter's stand where the hunter sits protected by a blind or sheet that wraps around the hunter to protect and camouflage the hunter. Such soft cases typically enclose the entire bow in a large cloth bag with a zipper opening at the top edge. These soft cases typically do not expose any part of the bow.

Compound bows used for hunting include a mechanical pulley and cam and stringing arrangement to reduce user effort and strength to propel an arrow. The compound bow also has an attachment for attaching a quiver and arrows. This overall combination is relatively bulky for transport. Thus, the quiver, which is attachable to a riser of a compound bow, must be disconnected from the bow and carried separately.

An example of a carrier for a compound bow where the bow is not completely enclosed is shown in U.S. Pat. No. 5,832,912. Such a carrier is intended to protect the pulleys and cam wheels of the compound bow. It does not include any blind in combination with the carrier and only adds to the complex number of items that the hunter carries to the woods.

Blinds, or camouflage sheets are used to hide or disguise the hunter and typically wrap around the hunter or the hunter's stand upon which the hunter sits. These are typically separate sheets of fabric and not typically integral or associated with the case. At least one combined archery bow case and blind is disclosed in U.S. Pat. No. 5,450,957 where the case itself opens to form the blind thus allowing for only a limited blind effect. The case completely encloses the bow and does not enable the bow to be transported with the quiver and arrows attached.

SUMMARY OF THE INVENTION

The present invention relates to a carrying case for compound bow, with several advantages over the prior art. The present invention enables the bow to remain attached with the quiver and arrows during transport. The case of the present invention enables the bow to be inserted into the case such that a side of the bow remains substantially exposed. The case includes a first or back face area that covers one side of the bow, and conforms generally to the shape of the bow, with edge portions that overlap about the bow to define a second or front face area. The front face defines a bow entry opening to enable the bow to be inserted. Tensioning elements, such as a drawstring, are used to secure the case fabric taut about the bow. Because the bow entry opening on the front face area enables the bow side to be substantially exposed, the bow quiver and arrows can remain attached and extend beyond the overall outline of the bow case, i.e. above the surface of the second, or front, face of the bow case.

The bow case of the present invention also provides for transport of a blind, i.e. a substantially larger flexible, i.e. non-rigid free-form sheet typically with a camouflage design impirinted thereon, which the hunter uses to enclose himself and the hunter's stand. The blind is removably attached to the case within a pocket located within the interior of the case, preferably on the inside of the back face of the case.

Thus, it is an object of the present invention to provide a lightweight, comfortable, and convenient case for a hunter for transporting a bow along with archery accessories to and from the hunting venue. It is further an object of the present invention to provide the bow case with the ability to carry an attached quiver and arrows which extend out of the case and remain exposed. Still further, it is an object of the present invention to provide a bow case with a blind that is removably affixed or attached to the case for removal.

These and other objects of the invention will be apparent from the following drawings and detailed description of the invention.

DETAILED DESCRIPTION OF THE PREFERRED EMBODIMENTS

Figure 1:
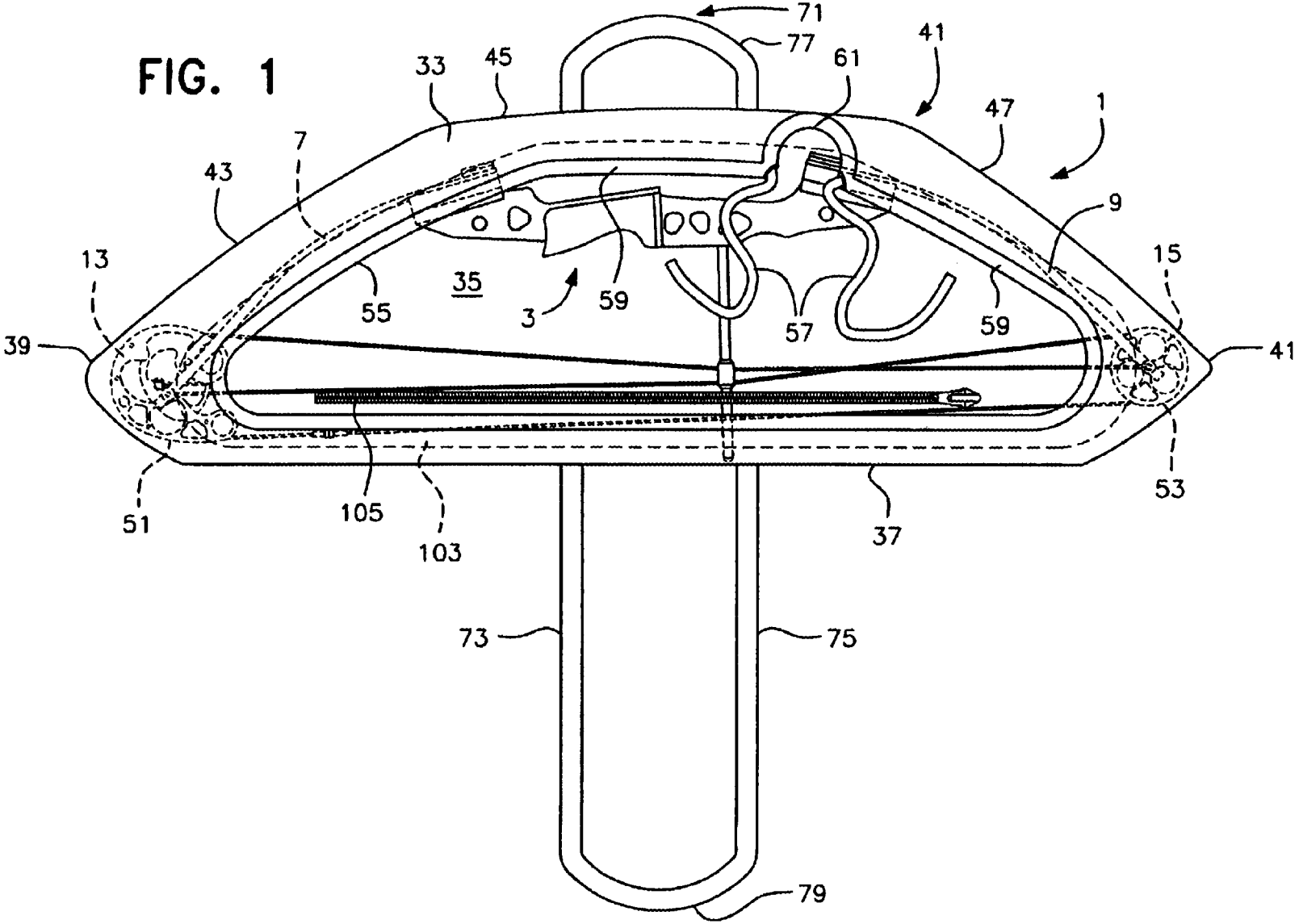
FIG. 1 is a side view of the bow case showing the front face area with a compound bow located within the case.
Figure 2:
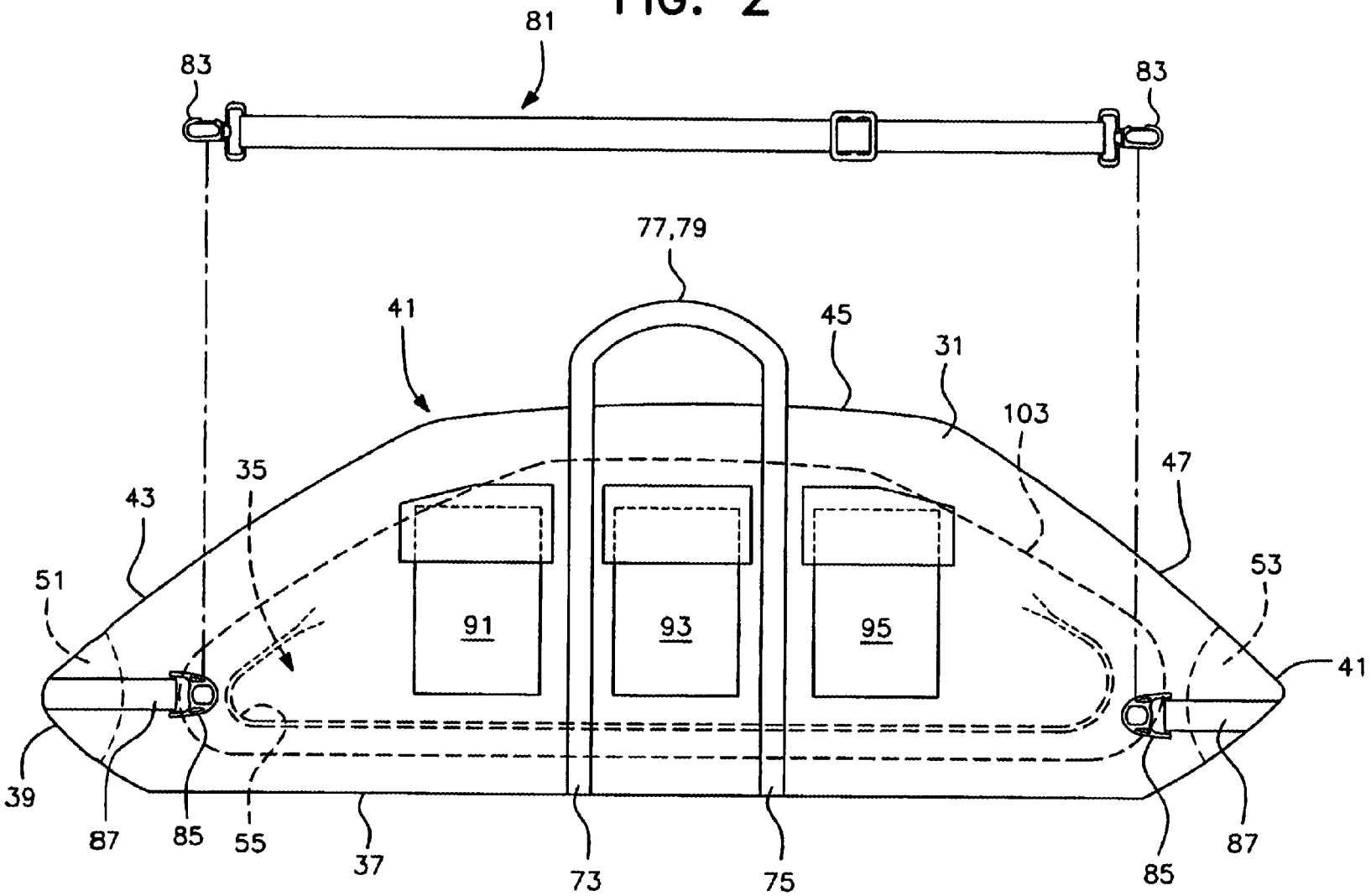
FIG. 2 is the opposite side view of the bow case showing the back face area with the sling or shoulder strap depicted.
Figure 3:
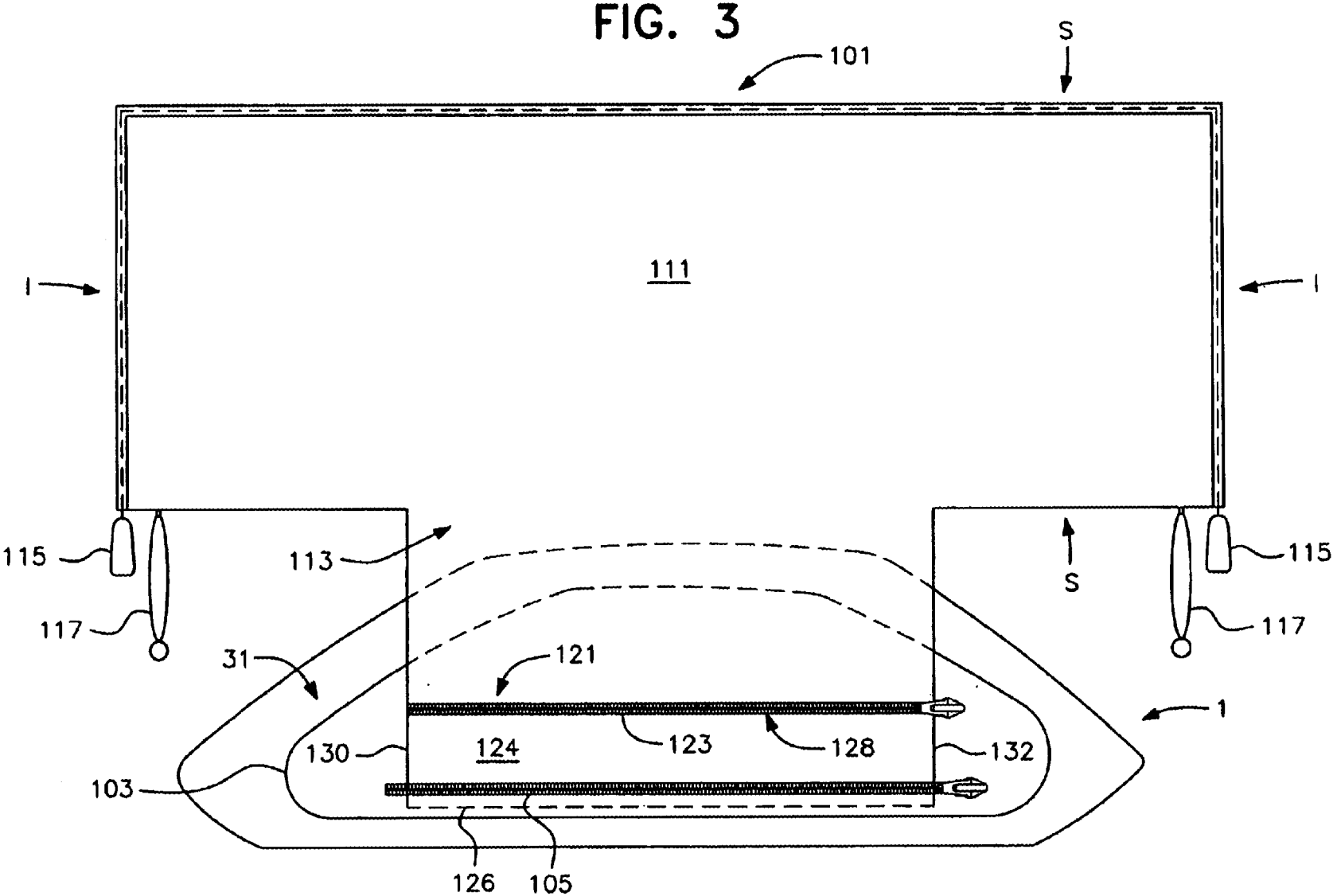
FIG. 3 is a view showing the interior of the back face with a blind zippered into a pocket in the back face, and removed from the pocket.

The bow case and blind combination 1 of the present invention is shown in FIGS. 1–3. FIG. 1 shows the bow case 1 with the compound bow 3 therewithin (without the bow quiver 5). A typical compound bow 3 with quiver attached is shown FIG. 4. The compound bow 3 includes a riser 5 and two limbs 7, 9 extending from the riser 5, an idler wheel 11 attached to limb 9 and a cam 13 attached to the limb 7. The compound bow 3 includes a cable and string arrangement 15 between the idler wheel 11 and cam 13. Separately attached to the compound bow 3 is a quiver 17 which is attached to the bow on one side of the riser 5. As depicted, the quiver 17 includes arrows 21.

A compound bow 3 typically has a length from limb end 23 to limb end 25 that is greater than the width perpendicular thereto, generally from the cable and string edge 27 to limb ends 29, 30. The thickness t—t of the bow, which is perpendicular to the page, is substantially less than either the length (between 23 and 25) or the width (between 27 and 29, 30). As used herein, the bow sides are defined as that part of the bow when looking at the bow from a direction into the page. One bow side has the quiver and arrows 17, 21 attached thereto.

The bow case 1 is formed from a soft flexible, cloth-like material that wraps around and generally conforms to the shape of the compound bow 3 carried within. The case 1 protects many parts of the bow including part of the cable and string 15, the cam 13 and idler wheel 11 and the limbs 7, 9, as well as a portion of the riser 5. The case includes a first or back side area or face 31 which, in the preferred embodiment,is a closed face which engages one side of the bow opposite the side that would attach to a quiver. A second or front area or face 33 defines a bow entry opening 35 for receiving the bow to be carried. The perimeter of the first and second faces includes a substantially linear bottom edge 37, curved side edges 39, 41 that extend from the bottom edge 37, and a substantially non-linear top edge 41 which, as depicted in the drawings, comprises three linear segments, 43, 45, 47 angled with respect to each other. It should be apparent that the top edge 41 could be curvilinear throughout its entire top region or even straight across. Each of the side ends 39, 41 of the case 1 accommodate the idler wheel and cam and include reinforcement areas 51, 53 to protect the wheel and cam. Preferably, the case is made of neoprene fabric or other waterproof material which may be lined on either side, or of waxed cloth. The fabric is preferably printed with a camouflage design.

The front face area 33 defines an opening 35 and includes an edge portion 55 which includes a tensioning means for drawing the edge portion 55 in a direction inwardly from the perimeter so that the casing remains relatively taut or secure about the bow 3 received within the case 1. The tensioning means is preferably a drawstring 57 located within a channel 59 about or around the edge portion 55 that defines the entry opening 35. The entry opening 35 is similar in overall shape to the overall shape of the casing 1. A cutout portion 61 is included, preferably to accommodate a stabilizer that is part of the compound bow, the stabilizer not shown. Of course, the cutout 61 for a stabilizer is not required and may be omitted without departing from the spirit of the present invention. The tensioning means is depicted as a drawstring 57 but may also include an elastic member (not shown) within the channel 59 or otherwise forming part of the edge portion 55 that would provide a tensioning force in an inward direction to hug the contours of the compound bow.

The first, or back, face 31 and second, or front, face 33 may be distinct fabric shapes that are sewn or otherwise connected together to have well-defined perimeter edge portions. Preferably, however, the first and second faces 31, 33 are formed from a unitary piece of cloth material where the second face 33 is formed from an edge portion of the fabric that extends around from the first face 31 to overlap the bow, the overlapped fabric defining the second face 33. In such an instance, when the compound bow is not within the case, the first and second faces may be indistinct in terms of where the first face ends and the second face begins.

The bow case 1 includes handles 71 that are preferably formed from two parallel straps 73, 75 interconnected by handle grip portions 77, 79 that interconnect the parallel straps at each opposite end. The two parallel straps 73, 75 are affixed to the first face 31 of the case substantially perpendicular to the bottom edge 37. The remaining portion of the parallel straps simply hang down, i.e. are unattached as shown in FIG. 1, and are intended to wrap around the second face 33 so that the handles 77, 79 face each other for carrying. Of course other handle arrangements could be used without departing from the scope of the present invention.

The bow case 1 also includes a carrying arrangement having a shoulder strap or sling 81 which is adjustable in length and is similar to shoulder straps that are known for carrying attache cases, etc. The strap 81 includes D-ring clips 83 for example which connect with support straps 87, having mating loops 85, that are sewn onto the back of the first face 31 of the case. For strength and reinforcement, the support straps 87 may be connected by a sewn strap (not shown) that extends entirely across the first face 31, sewn thereto, and to which are also sewn the straps 73, 75. The back of the first face 31 of the case also includes pockets 91, 93, 95 that may be closed by hook and loop connections or other snap-type closures, or remain open with an overlying fabric piece, as depicted. Additional pockets can be provided.

Figure 4:
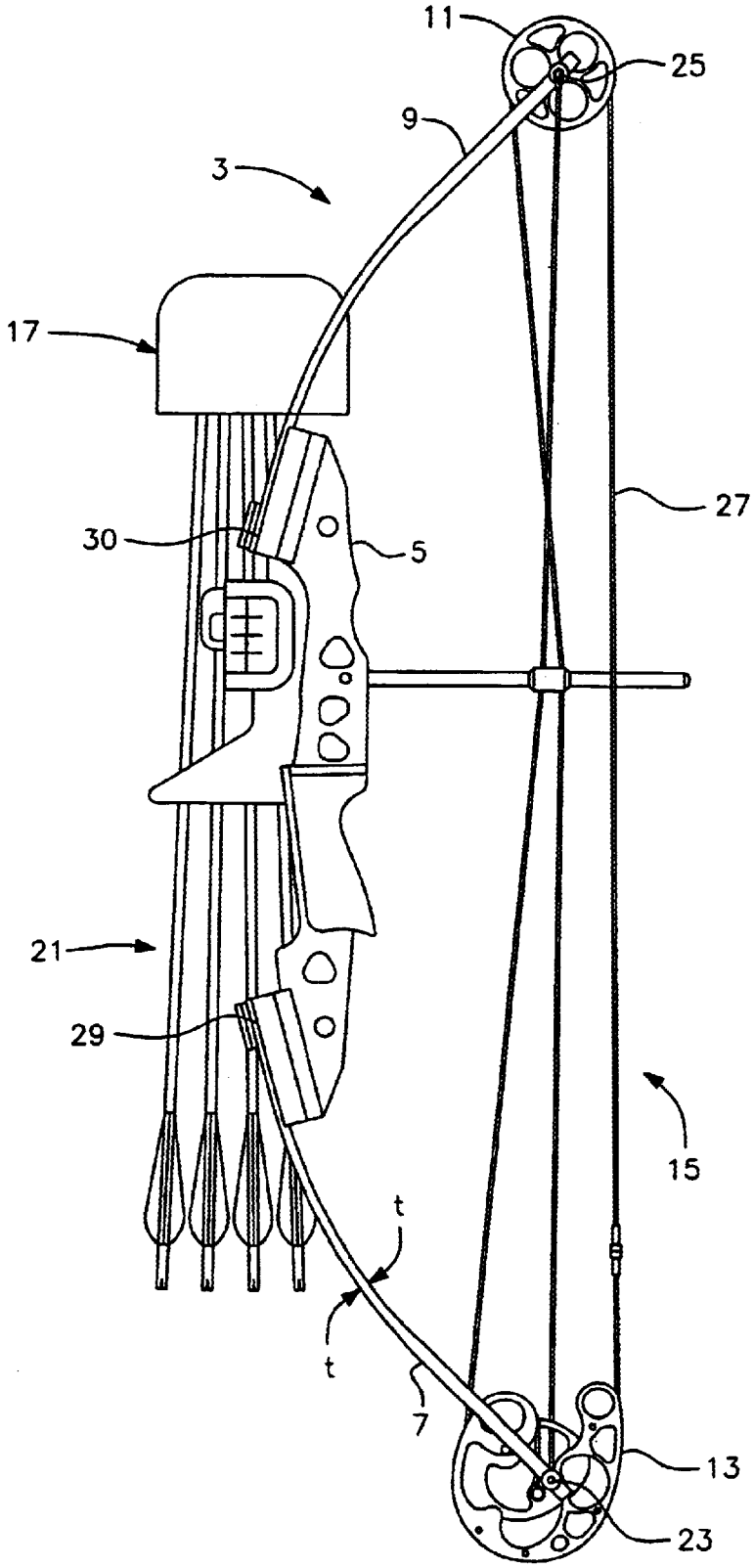
FIG. 4 is a typical compound bow depicting a quiver and arrow arrangement attached thereto.

One feature of the present invention provides for the bow entry opening 35 on the second, or front, face area 33 to comprise the majority of the surface area of the second face area 33. This enables a relatively large entry opening 35 for the compound bow 3 and enables a substantial portion of the compound bow 3 to be exposed during transport. The relatively large bow entry opening 35 also enables the quiver 17 and arrows 21 to remain attached to the compound bow during transport. Although the quiver and arrow combination is not shown attached to the compound bow in FIG. 1, it is apparent that it can remain attached, as shown in FIG. 4, and the quiver and arrows will extend out of the opening 35, in a plane lying substantially above the plane of the second face 33 and may be greater in overall length than the top part 45 of the case itself. By enabling the quiver and arrow combination 17, 21 to extend out of the overall casing confines, the quiver and arrow 17, 21 can remain attached to the bow 3 during transport.

The present invention also enables transport of a flexible, i.e. non-rigid blind 101 detachably connected with the bow case 1. Within the casing, affixed to the interior wall of the first, or back, face 31 is a relatively large pocket 103 for storing the blind 101. The pocket 103 is shown to be shaped substantially similar to the outline or perimeter of the first and second faces but other shapes can be constructed without departing from the scope of the invention. The pocket includes a zippered opening 105 to enable the blind 101 to be inserted and removed therefrom. Instead of a zipper, the pocket could also be closed by snaps or hook and loop type closures.

FIG. 3 depicts only the interior side of the first, or back, face 31 of the case to better disclose the blind storage pocket 103 and the blind 101 itself. The blind 101 is a fabric generally of camouflage-printed material that is flexible, i.e., non-rigid, and sufficiently sized to enable wrap-around of the hunter and/or the hunter stand as is well known in the art. It should be understood that the blind 101 shown in FIG. 3 is not necessarily to scale and the blind 101 is typically substantially greater in size than the size of the case 1 itself. For example, the overall end to end dimensions l—l of the blind 101 can be several feet in length such as eight to ten feet with the side edges s—s approximately four to five feet. By contrast, the total length of the case itself is typically less than four feet.

The blind 101 is shown in the shape of a fat T, although other shapes may be utilized. It is required only that the blind be sufficiently sized and shaped to function as to wrap around the hunter and/or hunter's stand. In the embodiment shown, the main body, 111 of the blind 101 is substantially rectangular and the T-shaped neck portion 113 is rectangular and extends from the main portion. The blind 101 includes a drawstring 115 that extends along three sides and is used to tie or draw the blind around the hunter or the hunter stand. Loops 117 are shown to hang the blind over suitable posts or nails that may be part of the hunter's stand. The loops could also be hook and loop straps or D-clips. The blind 101 is of a flexible, i.e. non-rigid cloth-like fabric and may be a fabric similar to that of the casing 1. Preferably, the blind may be made from a commercially-available fabric known as "3-D" fabric.

The blind 101 is detachably connected within the interior of the pocket at 121. As is shown in FIG. 3, one end of the T has a zipper connection 123 that zips into a fabric strip 124, which is sewn to the back wall of face 31 at edge 126. The fabric strip 124 has an edge 128, opposite to the edge 126, which forms part of the zipper 123. The sides 130, 132 of the strip 124 are unattached. In essence, the strip 124 is merely an extension of, and part of, the T-shaped neck portion 113. By utilizing the zipper connection 123, the blind 101 may be removed and exchanged with blinds of different camouflage designs. This is often needed to match the hunting season.

When the main zipper opening 105 of the pocket 103 is open, the blind 101 is removed by pulling it out through the zippered opening 105. As shown in FIG. 3, the blind 101 is attached within the pocket at zipper 123 to fabric strip 124 which, in turn, is sewn to the back wall at edge 126, within the pocket 103. The blind 101 extends out of the opening 105 of the blind pocket 103. It should be apparent that other connections to connect the blind to the fabric strip 124 are possible such such as snap hooks or buttons, etc. All of these are deemed equivalent. It is also within the scope of the invention to fix the blind 101 to the front wall of the pocket instead of the rear face which comprises the interior wall of the first, or back, face 31 of the bow case 1. During use, the blind can remain attached to the case or, alternatively, may be zipped out.

The above describes only preferred embodiments of the present invention. It should be apparent that other embodiments within the scope of the invention are possible within the full scope of the following claims.

What is claimed is:

1. A bow case and blind combination for receiving and carrying a bow comprising, a casing of flexible material having a first face and a second face opposite to the first face, said second face defining a bow entry opening for receiving the bow to be carried said first and second faces having a perimeter including a substantially linear bottom edge, substantially curved side edges extending from said bottom edge and a substantially non-linear top edge joining the side edges, the substantially non-linear top edge conforming to the shape of a bow with the ends of the bow accommodated within the side edges, wherein said second face includes an edge portion defining said bow entry opening with a tensioning means for drawing the edge portion bins a direction inwardly from the perimeter of said second face so as to be taut about a bow received within the case;

carrying means for carrying the case;

a blind storage pocket affixed to the interior of the first face within the case for storing a blind, said blind storage pocket including an opening to enable removal of said blind;

a blind comprising a sheet of flexible material removably stored within said blind storage pocket, the surface area of said sheet larger than the surface area of said first face of said case and foldable so as to be stored within said blind storage pocket.

2. The bow case and blind combination of claim 1 wherein said edge portion defining said bow entry opening is shaped substantially similar to the perimeter of said first and second faces.

3. The bow case and blind combination of claim 1 wherein the majority of the surface area of said second face is defined by said bow entry opening so as to enable the bow to be substantially exposed.

4. The bow case and blind combination of claim 1 wherein said tensioning means comprises a draw string located within a channel formed at the edge portion of said bow entry opening.

5. The bow case and blind combination of claim 1 wherein said carrying means comprises a handle.

6. The bow case and blind combination of claim 5 wherein said handle comprises two parallel straps affixed along part of their length to the exterior of said first face of said case substantially perpendicular to said bottom edge, and unattached along the remaining part of their length, handle grip portions interconnecting said parallel straps at each opposite end of the parallel straps, wherein the unattached length of the parallel straps are wrappable about said second face to enable the handle grip portions to face each other for gripping.

7. The bow case and blind combination of claim 5 wherein said carrying means further comprises a shoulder sling.

8. The bow case and blind combination of claim 7 wherein said shoulder sling comprises an elongated strap, a pair of support straps, each of said pair affixed to said first face adjacent each side edge, and means for attaching said elongated strap to said support straps.

9. The bow case and blind combination of claim 1 wherein said blind storage pocket opening is a zippered opening.

10. The bow case and blind combination of claim 1 wherein said blind is affixed within said blind storage pocket.

11. The bow case and blind combination of claim 10 wherein said blind is detachably affixed within said blind storage pocket.

12. The bow case and blind combination of claim 11 wherein said blind is detachably affixed by a zipper.

13. The bow case and blind combination of claim 1 wherein said sheet of flexible cloth material forming said blind is substantially T-shaped having a substantially rectangular main blind portion with a rectangular neck portion extending therefrom, said rectangular neck portion detachably connected within said blind storage pocket.

14. The bow case and blind combination of claim 13 wherein said rectangular main blind portion includes a drawstring located within a channel formed along three side edges of said rectangular main blind portion.

15. The bow case and blind combination of claim 1 wherein each of said first and second faces include a reinforcing liner located at said substantially curved side edges.

16. A bow case and compound bow combination wherein the compound bow includes a riser, a pair of limbs extending from the riser and an idler wheel and cam arrangement at opposite ends of each limb, the riser including an attachment system for attaching a quiver thereto, said quiver lying on one side of the compound bow, wherein the case comprises a flexible fabric having a bow entry opening therein with tensioning means around the bow entry opening, whereby the flexible fabric covers one side of the bow and extends around portions of the bow to cover the perimeter of the bow leaving the central region of the bow exposed through the bow entry opening, the casing fabric accommodating itself to the shape of the bow, wherein said tensioning means tensions the fabric around the bow, whereby a quiver attachable to one side of the bow may extend out of the bow entry opening.

17. The bow case and compound bow combination of claim 16 further comprising a blind detachably connected to the interior of the bow casing.

18. The bow case and bow combination of claim 17 wherein said blind is detachably connected within a bow case pocket formed on the interior wall of the bow case fabric.

* * * * *